US007012445B2

(12) United States Patent
Itagaki

(10) Patent No.: US 7,012,445 B2
(45) Date of Patent: Mar. 14, 2006

(54) METHOD FOR TESTING A TFT ARRAY

(75) Inventor: Nobutaka Itagaki, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/003,166

(22) Filed: Dec. 3, 2004

(65) Prior Publication Data

US 2005/0206404 A1 Sep. 22, 2005

(30) Foreign Application Priority Data

Mar. 18, 2004 (JP) ..... 2004-079037

(51) Int. Cl.
*G01R 31/00* (2006.01)

(52) U.S. Cl. ..... 324/770; 324/158.1

(58) Field of Classification Search ..... 324/770
See application file for complete search history.

(56) References Cited

U.S. PATENT DOCUMENTS 5,377,030 A * 12/1994 Suzuki et al. ..... 349/187
2004/0032278 A1 * 2/2004 Orii et al. ..... 324/765
2005/0093567 A1 * 5/2005 Nara et al. ..... 324/770

FOREIGN PATENT DOCUMENTS

EP 1 414 005 4/2004
JP 10-096754 4/1998

* cited by examiner

*Primary Examiner*—Vinh Nguyen
*Assistant Examiner*—Emily Y Chan

(57) ABSTRACT

A method for testing a TFT array that comprises one or a plurality of first pixels including capacitors connected to one terminal of pixel selection switches, one or a plurality of second pixels including capacitors connected to one terminal of pixel selection switches, and data lines connected to the other terminals of the pixel selection switches of the first pixels and the other terminals of the pixel selection switches of the second pixels, wherein the method for testing comprises a step for charging the capacitors of the first pixels to a first voltage, a step for charging the capacitors of the second pixels to a second voltage, a step for turning on both the pixel selection switches of the first pixels and the pixel selection switches of the second pixels, and a step for measuring either one or both of the voltage of a data line or the charge flowing through the data line.

8 Claims, 6 Drawing Sheets

METHOD FOR TESTING A TFT ARRAY

FIELD OF THE INVENTION

The present invention relates to a method for testing thin film transistors (TFTs), more particularly, to testing the quality of the pixels in the TFT array in a flat panel display (FPD).

DISCUSSION OF THE BACKGROUND ART

Over the past few years, flat panel displays such as liquid crystal displays and electroluminescent (EL) displays have become the main trends in displays. This type of FPD is constructed by enclosing liquid crystal or EL elements, which are the elements used for display, in a TFT array that arranges a plurality of pixels in a matrix.

FIG. 5 shows a TFT array 10 of a typical liquid crystal display. The TFT array 10 is constructed from a plurality of pixels (i.e., 50) arranged in a matrix, pixel selection lines (i.e., 20, 30) for selecting the display pixels, and pixel selection circuits 11, 12 for controlling the pixel selection lines.

A pixel 50 is constructed from a switching transistor 52 (pixel selection switch) where pixel selection lines 21, 32 are connected to the drain terminal and the gate terminal, respectively, and a capacitor 51 connected to the source terminal of the switching transistor 52. The liquid crystal enclosed in the TFT array 10 is controlled by the voltage of the capacitor 51. In FIG. 1, one terminal of the capacitor 51 is grounded, but is sometimes connected to a specified voltage source installed externally without grounding depending on the usage state of the TFT array.

For a TFT array used in an EL display, the pixel structure shown in FIG. 6 is typical. The difference from pixel 50 in FIG. 5 is a transistor 81 for driving the EL element is connected on the source side of the switching transistor 52. Since the EL element 81 (not enclosed in the TFT array state) is a light-emitting element wherein the emitted light brightness is changed by the drive current, the voltage charged in the capacitor 51 is converted into current by the transistor 81.

The pixel selection lines are constructed from a plurality of gate lines 31, 32, 33 and a plurality of data lines 20, 21, 22. The display pixel at an intersection is selected by selecting the gate line and the data line connected to the display pixel. For example, pixel 50 at an intersection is selected by selecting gate line 32 and data line 21. The gate lines 31, 32, 33 are digital signal lines, and have +5 V applied in the selected state and 0 V applied in the not-selected state. The data lines 20, 21, 22 are analog signal lines, and the voltage charged in the capacitor 51 in the pixel 50 is applied. In other words, the data lines 20, 21, 22 are the pixel selection lines combining both the function of specifying the position of the display pixel and the function of applying the voltage for controlling the liquid crystal for the display pixel.

The pixel selection circuits 11, 12 are constructed from a vertical pixel selection circuit 11 and a horizontal pixel selection circuit 12. The vertical pixel selection circuit 11 inputs an external signal that becomes the liquid crystal control voltage (voltage from voltage source 45 in FIG. 5) to the data lines connected to the display pixels. The horizontal pixel selection circuit 12 applies +5 V to the gate lines connected to the display pixels.

A method for testing the TFT array 10 is a method that charges the capacitor 51 of a pixel and measures the electric charge or the voltage (see Japanese Kokai Unexamined Patent 2003-43,945 and Kokai Unexamined Patent H10 [1998]-96,754). This method for testing is described with reference to FIGS. 5 and 7 below. In the test, a voltmeter 42 and a switch 41 are connected at the input of the vertical pixel selection circuit 11, and a voltage source 45 having an output voltage V is connected to the other terminal of the switch 41.

Initially, the switch 41 is set in the "on" state. Gate line 32 of pixel 50, which is the test subject, is selected and a voltage V is applied to the data line 21 by the pixel selection circuits 11, 12. Then the switching transistor 52 of the pixel 50, which is the device under test, enters the "on" state, and the voltage V is charged in the capacitor 51. Next, the switch 41 is set in the "off" state, the voltage application to the data line 21 stops, and the voltage of the data line 21 is measured by the voltmeter 42. If both the switching transistor 52 and the capacitor 51 are operating normally, the data line 21 should maintain the voltage V. Since the measured voltage of data line 21 does not become V when the switching transistor 52 is not operating, and a pixel defect such as poor charging of the capacitor 51 has occurred, the presence or absence of a pixel defect can be determined by measuring the voltage V of data line 21. Finally, the discharge cycle is executed wherein the voltage of the voltage source 45 is set to 0 V, the switch 41 is set in the "on" state, and the capacitor 51 discharges. This procedure tests the quality of all of the pixels and evaluates the quality of the TFT array 10.

A TFT array 80 for an EL display can be tested by a similar procedure because the circuit structure in the stage before the transistor 81 for driving is no different than in pixel 50 for the liquid crystal.

In the test described above, since the cycle of charging, measuring, and discharging of each pixel in the TFT array 10 is repeated, the problem is the long time needed until the measurement of the entire TFT array 10 is completed.

SUMMARY OF THE INVENTION

The present invention is a method for testing a TFT array that comprises one or a plurality of first pixels that include capacitors connected to one terminal of the pixel selection switch, one or a plurality of second pixels that include capacitors connected to one terminal of the pixel selection switch, and data lines connected to the other terminals of the pixel selection switches of the first pixels and the other terminals of the pixel selection switches of the second pixels, which solves the above-mentioned problem by a method for testing that comprises a step for charging the capacitors of the first pixels to a first voltage, a step for charging the capacitors of the second pixels to a second voltage, a step for turning on both the pixel selection switches of the first pixels and the pixel selection switches of the second pixels, and a step for measuring either one or both of the voltage of a data line and the charge flowing through a data line.

The time needed to test the entire TFT array is reduced by simultaneously testing a plurality of pixels. Furthermore, by reversing the polarity of the voltage supplied to the capacitors of a plurality of pixels during testing, measuring and discharging can be simultaneously performed for normal pixels, and the testing time can be reduced.

The present invention can reduce the testing time of a TFT array.

DETAILED DESCRIPTION OF THE PREFERRED EMBODIMENT

A signal generator in a preferred embodiment of the present invention is described in detail below with reference to the drawings.

Figure 1:
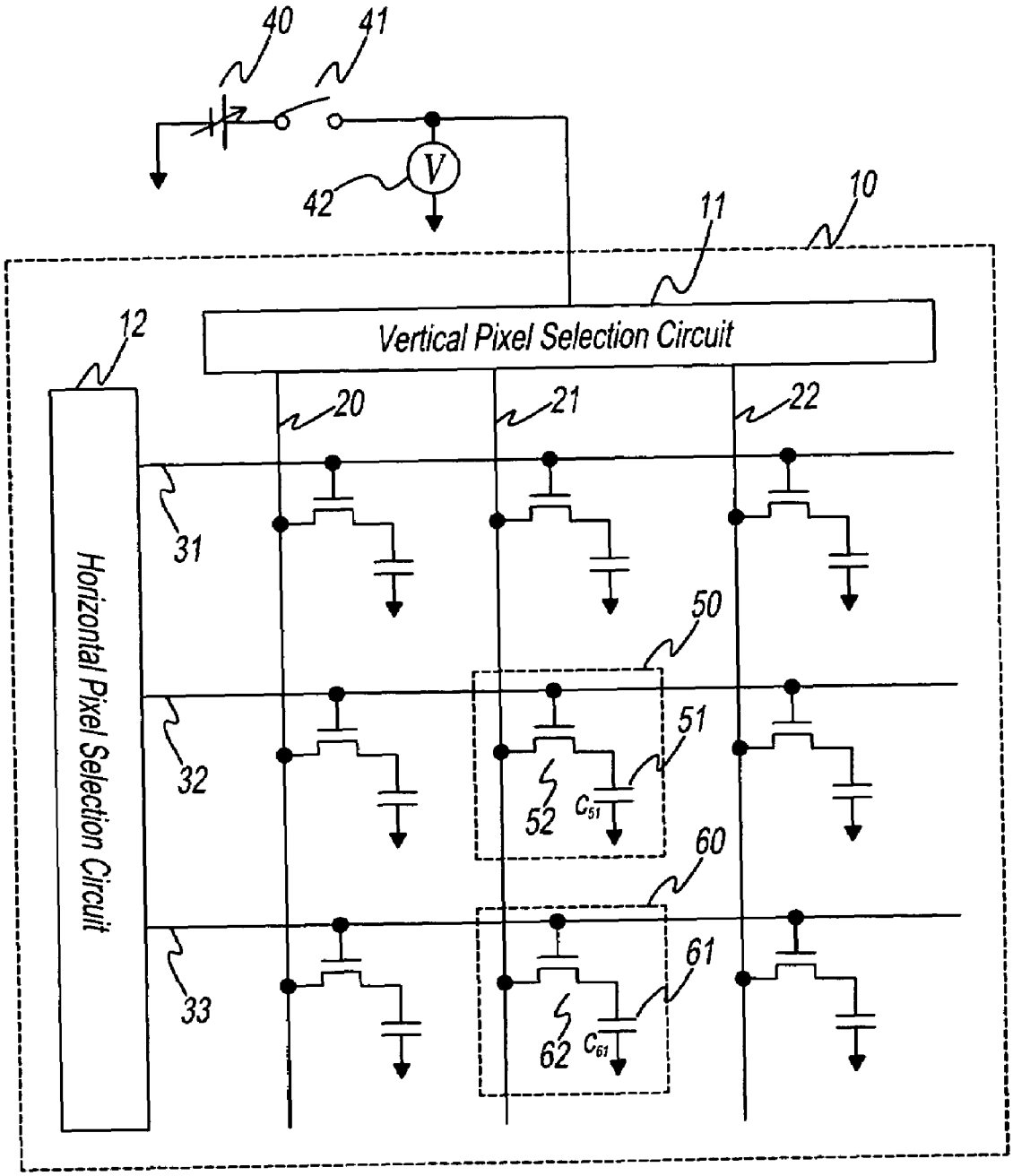
FIG. 1 is a schematic view of the structure of a first embodiment of the present invention.

FIG. 1 shows the connection structure of the equipment of the method for testing related to the first embodiment according to the present invention. The TFT array 10 is identical to the one described in the Prior Art section. In the following description, to distinguish the capacitances, the capacitance of capacitor 51 is denoted by $C_{51}$ and the capacitance of capacitor 61 is denoted by $C_{61}$. When both capacitors 51, 61 are normal, the capacitances become equal ($C_{51}=C_{61}$). The voltmeter 42 and the switch 41 are connected to the input of the vertical pixel selection circuit 11, and a variable voltage source 40 is connected to the other terminal of the switch 41.

Figure 2:
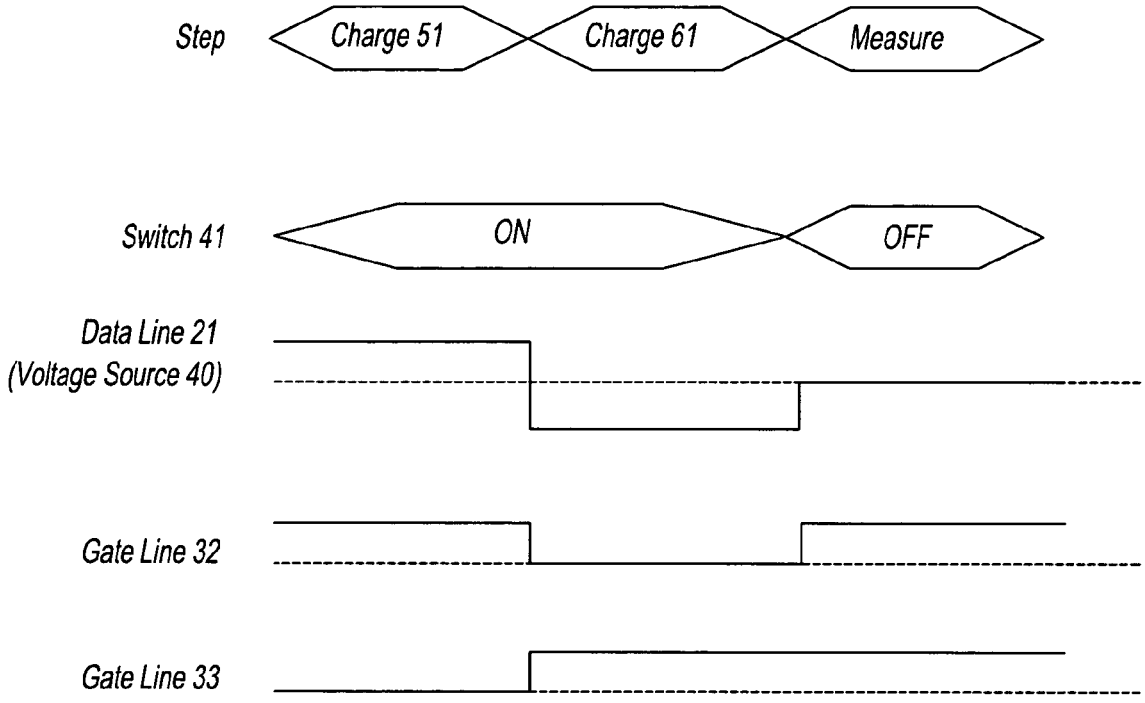
FIG. 2 is a timing chart of the first embodiment of the present invention.

The method for testing related to the present invention is explained below based on the schematic drawing in FIG. 1 and the timing chart in FIG. 2. First, the voltage of the voltage source 40 is set to $V_1$, and a gate line 32 is selected by the horizontal pixel selection circuit 12 and a data line 21 is selected by the vertical pixel selection circuit 11. Then the switching transistor 52 of the pixel 50 enters the "on" state, and the capacitor 51 charges to voltage $V_1$. At this time, the charge $Q_{51}=C_{51}\times V_1$ accumulates in the capacitor 51. Next, the voltage of the voltage source 40 is set to $-V_1$, and the gate line 33 is selected by the horizontal pixel selection circuit 12. Then switching transistor 62 of pixel 60 enters the "on" state, and capacitor 61 charges to the voltage of $-V_1$. At this time, the charge $Q_{61}=C_{61}\times(-V_1)$ accumulates in capacitor 61. Then switch 41 is set in the "off" state and the supply of the voltage source stops, and both gate lines 32 and 33 are selected by the horizontal pixel selection circuit. Both switching transistors 52 and 62 enter the "on" state, and capacitor 51 and capacitor 61 are connected via data line 21.

In this state, the potential of data line 21 is measured by the voltmeter 42. If both capacitors 51, 61 function normally, the charges mutually cancel because $Q_{51}=-Q_{61}$ due to $C_{51}=C_{61}$, and the measured voltage becomes 0 V. If a defect is present in one capacitor and the capacitance $C_{51}$ of capacitor 51 differs from the capacitance $C_{61}$ of capacitor 61, the measured voltage becomes $V_2=Q_r/(C_{51}+C_{61})$ because the residual charge becomes $Q_r=(C_{51}-C_{61})\times V_1$ after cancellation. From this measurement result, the capacitance ratio of the two capacitors can be determined to be $C_{51}/C_{61}=(V_1+V_2)/(V_1-V_2)$.

When both pixels 50, 60 are normal, since the charges remaining in the capacitors 51, 61 are canceled in the measurement stage and become nearly 0, the test of another pixel is immediately begun after the measurement ends. If there is a defective pixel, the next test is entered after the voltage source 40 is set to 0 V, the switch 41 is set in the "on" state, and the charges of the capacitors 51, 61 are removed. If a defective pixel is found and it must be determined whether capacitor 51 or 61 is the defective pixel, a quality decision for each pixel (for example, the method explained in the Prior Art section) is implemented separately.

Since the number of defective pixels is extremely small compared to the number of good pixels, the time needed for testing can be substantially reduced because the method tests each pixel as needed after the decision of whether defective pixels are included when a plurality of pixels is tested simultaneously as in this invention. Furthermore, by setting the opposite potential having the same absolute value as the potential charging the capacitor, the discharge cycle is no longer needed and the test time can be further reduced because the defect test (measurement) and the discharge of the capacitor of the pixel being tested can be performed simultaneously.

In this embodiment, two pixels are tested simultaneously, but at least 4 pixels can be tested simultaneously by the same method. In particular, when few defective pixels are known beforehand to be present as in product testing during mass production, according to the present invention, the testing time can be reduced by initially detecting whether defective pixels are included, and conducting a more detailed test only when defective pixels are included in the test subject range.

For example, eight pixels connected to the same data line are divided into two groups of four pixels. The capacitors of the pixels belonging to the first group charge to voltage V, and the capacitors of the pixels belonging to the second group charge to voltage −V. Then the capacitors of the eight pixels are connected via a data line, and the charge of each capacitor is canceled. As a result, if the voltage of the data line becomes 0 V, all of the pixels are judged to operate normally, and the testing of other pixels is begun. Thus, whether defective pixels are included in eight pixels can be determined in one test.

An electric charge meter or ammeter is set up instead of the voltmeter 42 in FIG. 1. The charge $Q_r=(C_{51}-C_{61})\times V_1$ flowing in data line 21 is measured after the charges of capacitors 51, 61 cancel, and the presence of defects can be determined based on the capacitance difference $C_{51}-C_{61}=Q_r/V_1$ of capacitors 51, 61. If both pixels 50, 60 are normal, the capacitance difference becomes 0.

Furthermore, for a given TFT array 10 specification and test equipment configuration, with the one voltage source of voltage source 40, the test can be performed by changing the voltages charged in capacitors 51 and 61. If the charged voltage of capacitor 51 is allowed to be $V_{51}$ and the charged voltage of capacitor is $V_{61}$, then the measured voltage $V_2$ becomes $(C_{51}V_{51}+C_{61}V_{61})/(C_{51}+C_{61})$. By determining whether the capacitance ratio $C_{51}/C_{61}=(V_{61}-V_2)/(V_2-V_{51})$ of both capacitors falls within the margin, the pixel quality can be determined. In this case, since the charges of capacitors 51, 61 do not cancel and become 0 during measurement, the measurement time becomes long compared to when both voltage sources are voltage source 40 because a discharge cycle becomes necessary after the measurement ends.

When the charged voltage $V_{51}$ of the capacitor and the charged voltage $V_{61}$ of capacitor 61 are set, testing is simple when one voltage is set to be an integer multiple of the other voltage. For example, if both capacitors 51, 61 are normal when $V_{61}=3V_{51}$, the quality can be decided by determining whether the voltage of $V_2$ divided by 2 by resistors, for example, and the charged voltage $V_{51}$ are the same voltage since the measured potential becomes $V_2=2V_{51}$.

Figure 3:
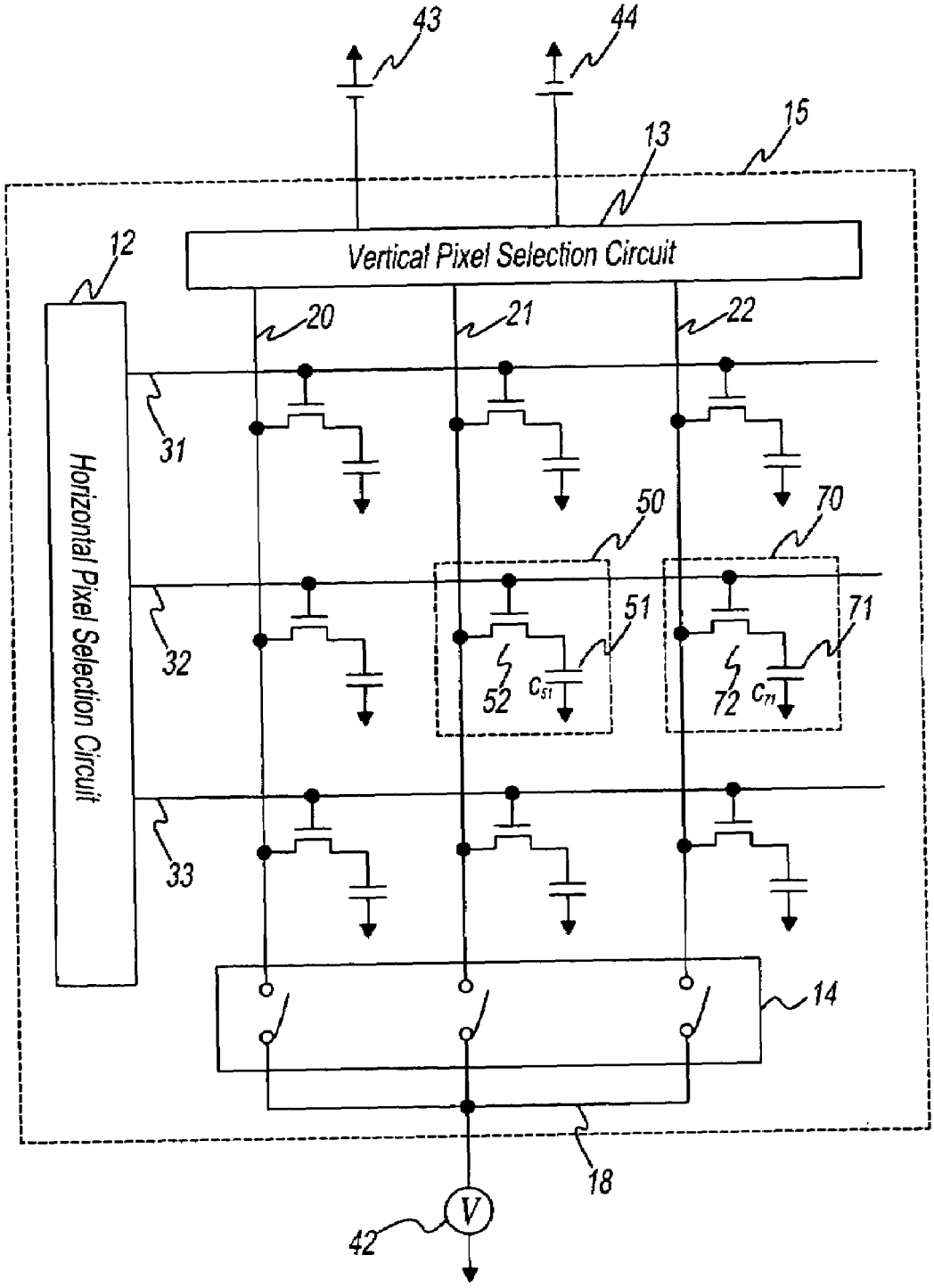
FIG. 3 is a schematic view of the structure of the second embodiment of the present invention.
Figure 4:
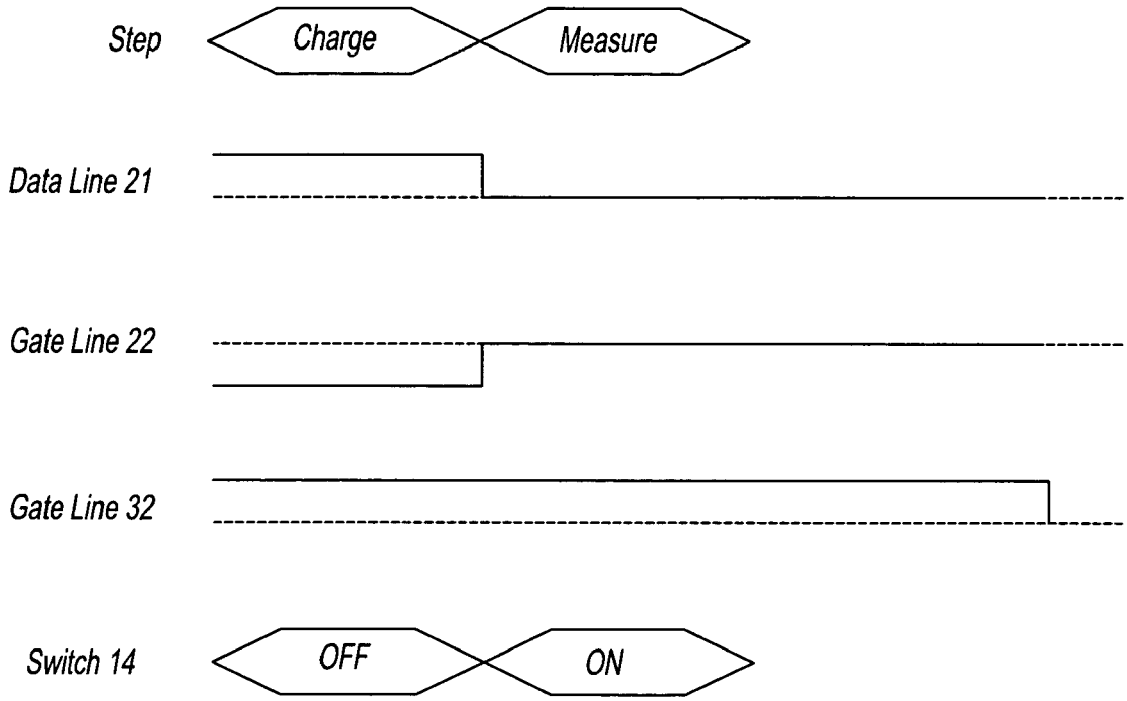
FIG. 4 is a timing chart of the second embodiment of the present invention.
Figure 5:
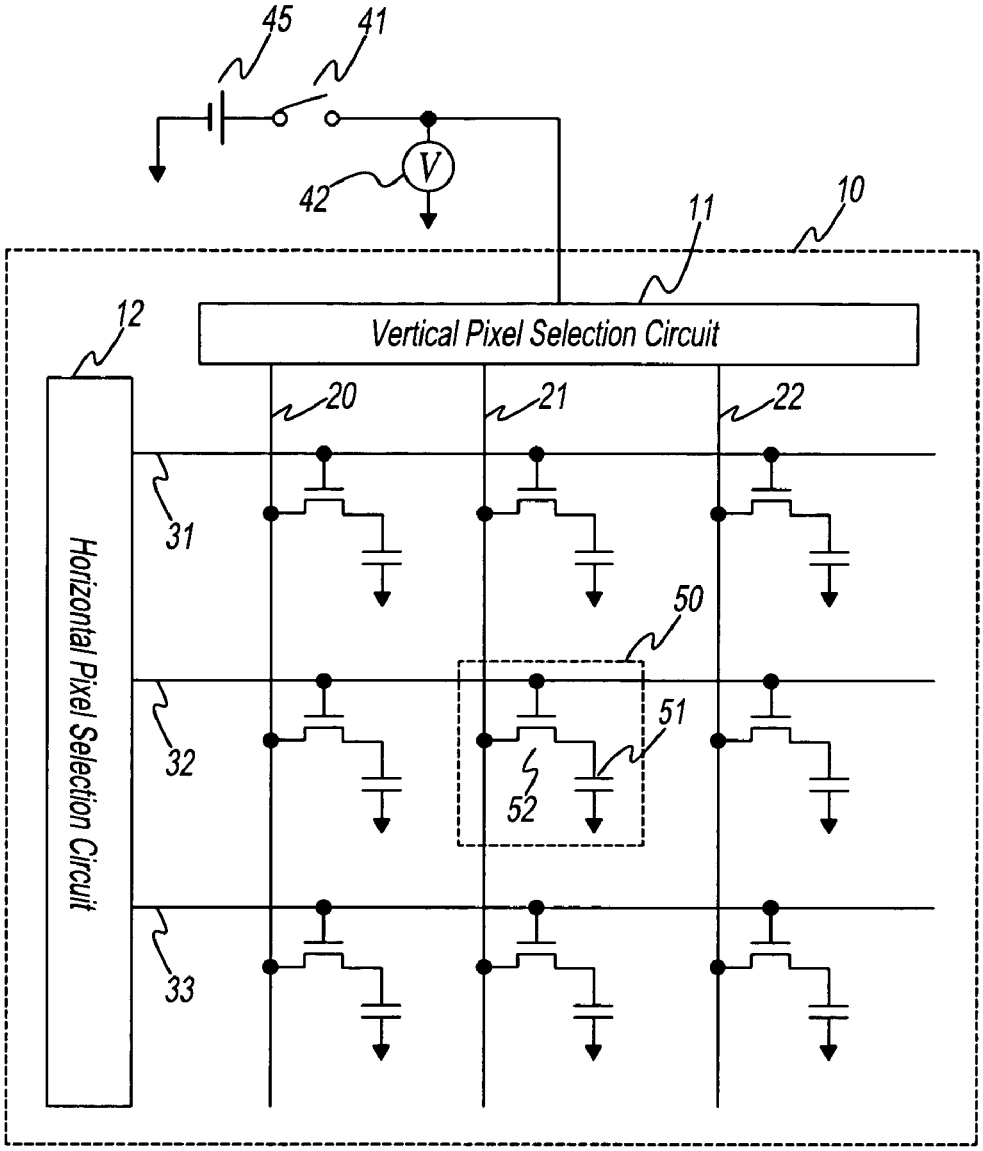
Fig. 5 (Prior Art)
FIG. 5 is a schematic view of the structure of a method for testing of the prior art.
Figure 6:
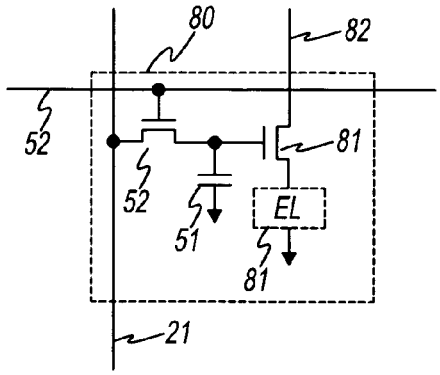
Fig. 6 (Prior Art)
FIG. 6 is a view of the structure of an EL display pixel of the prior art.
Figure 7:
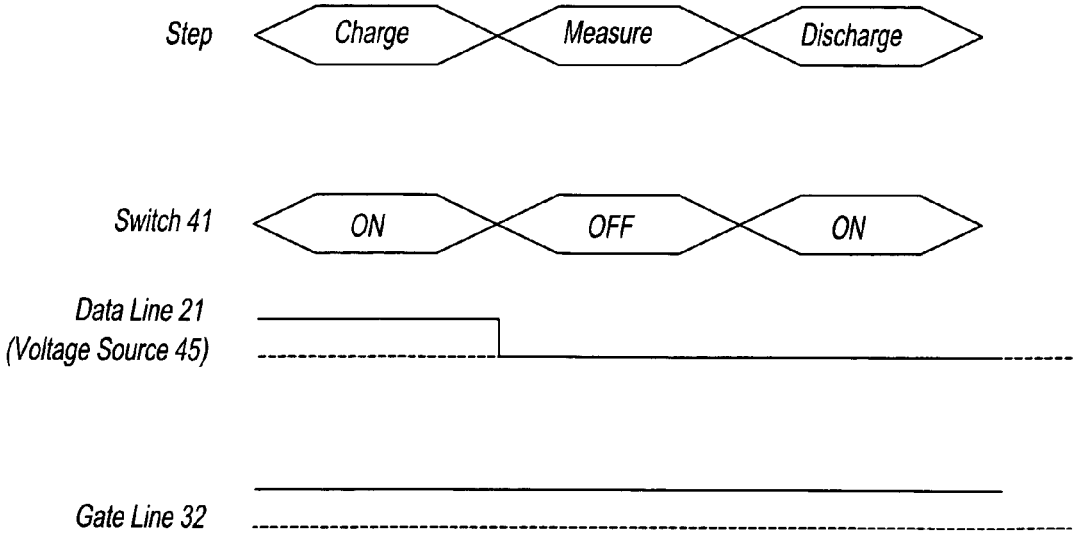
Fig. 7 (Prior Art)
FIG. 7 is a timing chart of a method for testing of the prior art.

A second embodiment of the present invention is explained with reference to the schematic drawing of FIG. 3 and the timing chart in FIG. 4. The TFT array 15 of the present embodiment differs from the TFT array 10 of the embodiment described previously in the function of the vertical pixel selection circuit 13 and the provision of switches 14. First, the vertical pixel selection circuit 13 has two input lines and a function for outputting the input signal from each input line to any data line. In addition, a switch 14 is provided at the terminal of each data line 20, 21, 22. A shared line 18 is set up at the other terminals of the switches 14, and all of the data lines can be electrically connected via the shared line 18 by setting the switches 14 in the "on" state.

In the test of the TFT array 15, voltage sources 43, 44 (output voltages of $V_1$ and $-V_1$, respectively) having output voltages of equal absolute values and opposite polarities are connected to the input of the vertical pixel selection circuit 13. The voltmeter 42 is set up on the shared line 18.

First, the gate line 32 is selected by the horizontal pixel selection circuit 12. The input from voltage source 43 is connected to data line 21, and the input from voltage source 44 is connected to data line 22 by the vertical pixel selection circuit 13. The switches 14 are set in the "off" state. Then the switching transistor 52 of pixel 50 enters the "on" state, and the capacitor 51 is charged to $V_1$. Simultaneously, the switching transistor 72 of pixel 70 also enters the "on" state, and the capacitor 71 is charged to $-V_1$. Then the connections between voltage sources 43, 44 and data lines 21, 22 are disconnected by the vertical pixel selection circuit 13. Next, by setting the switches 14 in the "on" state, the charge $Q_{51}$ accumulated in capacitor 51 and the charge $Q_{71}$ accumulated in capacitor 71 cancel via the shared line 18.

The voltage of the shared line 18 is measured by the voltmeter 42. If the capacitance $C_{51}$ of capacitor 51 is equal to the capacitance $C_{71}$ of capacitor 71, since $Q_{51}=-Q_{71}$, the charges mutually cancel, and the measured voltage becomes 0 V. If one of the capacitors is defective and the capacitance $C_{51}$ of capacitor 51 differs from the capacitance $C_{71}$ of capacitor 71, the measured voltage becomes $V_2=Q_r/(C_{51}+C_{71})$ because the residual charge is $Q_r=(C_{51}-C_{71})$ after cancellation. From this measurement result, the capacitance difference $C_{51}/C_{71}=(V_1+V_2)/(V_1+V_2)$ between the two capacitors can be determined.

If both pixels 50, 70 are good, since the charges remaining in capacitors 51, 71 become approximately 0, the testing of other pixels is immediately begun after the measurement by the voltmeter 42 ends. If a defective pixel is present, after the other terminal of switches 14 is grounded and the charges of capacitors 51, 61 are removed, the next test is begun.

In this second embodiment, since a plurality of capacitors 51, 71 can be simultaneously charged, the testing time can be further reduced compared to the first embodiment discussed above. Similar to the first embodiment, in this second embodiment, at least four pixels are simultaneously measured and the measurement time can be reduced. An electric charge meter or an ammeter instead of a voltmeter 42 can detect the difference in the capacitances of capacitors 51, 71. Furthermore, if the voltage sources 43, 44 have the same polarity, the test can be performed by a method similar to the description in the first embodiment.

Above, the technical concepts related to the present invention were described in detail while referring to specific embodiments, but various modifications and improvements can be added without departing from the intent and scope of the claims by a person skilled in the art related to the present invention. For example, the specific numerical values of the voltages indicated in the embodiments can be appropriately changed according to the specification of the device under test and the configuration of the test equipment.

What is claimed is:

1. A method for testing a TFT array that comprises:

one or a plurality of first pixels including capacitors connected to one terminal of pixel selection switches, one or a plurality of second pixels including capacitors connected to one terminal of pixel selection switches; and data lines connected to the other terminals of the pixel selection switches of the first pixels and to the other terminals of the pixel selection switches of the second pixels, wherein the method for testing comprises:

charging the capacitors of the first pixels to a first voltage;

charging the capacitors of the second pixels to a second voltage;

setting the pixel selection switches of the first pixels and the pixel selection switches of the second pixels in the "on" state; and measuring either one or both of a voltage of a data line and a charge flowing in a data line.

2. The method for testing according to claim 1, wherein the second voltage has the same absolute value and the opposite polarity of the first voltage.

3. The method for testing according to claim 1, wherein the second voltage is an integer multiple of the first voltage.

4. The method for testing according to claim 1, wherein the number of first pixels is equal to the number of second pixels.

5. The method for testing a TFT array that comprises:

one or a plurality of first pixels including capacitors connected to one terminal of pixel selection switches;

first data lines connected to the other terminal of the first pixel selection switches;

one or a plurality of second pixels including capacitors connected to one terminal of pixel selection switches; and second data lines connected to the other terminals of the second pixel selection switches, wherein the method for testing comprises:

charging the capacitors of the first pixels to a first voltage;

charging the capacitors of the second pixels to a second voltage;

setting the pixel selection switches of the first pixels and the pixel selection switches of the second pixels in the "on" state;

connecting the first data lines and the second data lines to a shared line; and measuring either one or both of a voltage of the shared line or a charge flowing in the shared line.

6. The method for testing according to claim 5, wherein the second voltage has the same absolute value and the opposite polarity of the first voltage.

7. The method for testing according to claim 5, wherein the second voltage is an integer multiple of the first voltage.

8. The method for testing according to claim 5, wherein the number of first pixels is equal to the number of second pixels.

* * * * *